United States Patent [19]

Seragnoli

[11] Patent Number: 4,534,253

[45] Date of Patent: Aug. 13, 1985

[54] FEEDING AND CUTTING DEVICE FOR A CONTINUOUS WEB

[75] Inventor: Enzo Seragnoli, Bologna, Italy

[73] Assignee: G. D. Societa' per Azioni, Bologna, Italy

[21] Appl. No.: 381,046

[22] Filed: May 24, 1982

[30] Foreign Application Priority Data

Jun. 3, 1981 [IT] Italy ..... 3453 A/81

[51] Int. Cl.[3] ..... B25D 1/56; B23D 25/02

[52] U.S. Cl. ..... 83/336; 83/367; 83/371; 83/365

[58] Field of Search ..... 83/343, 365, 370, 371, 83/286, 289, 76, 367, 336, 236; 53/389

[56] References Cited

U.S. PATENT DOCUMENTS

| | | | |
|---|---|---|---|
| 3,983,774 | 10/1976 | Seragnoli | 83/289 |
| 4,267,752 | 5/1981 | Byrt et al. | 83/76 |
| 4,287,797 | 9/1981 | Seragnoli | 83/76 |

FOREIGN PATENT DOCUMENTS

| | | | |
|---|---|---|---|
| 1022157 | 3/1966 | United Kingdom | 83/236 |

*Primary Examiner*—Donald R. Schran
*Assistant Examiner*—James Wolfe
*Attorney, Agent, or Firm*—Marshall, O'Toole, Gerstein, Murray & Bicknell

[57] ABSTRACT

A device for feeding a continuous web, for cutting it into pieces and having automatic reel change for changing the reels from which the web is unwound is described. This device includes a cyclic cutting device positioned at the confluence of two tracks, along which two continuous webs are unwound from corresponding reels are fed, and controls for controlling the generation of a signal when an associated reel is exhausted; along each of the tracks there are provided a mechanism for feeding the webs from the reels to the cutting device, and such feeding mechanism include, for each track, a pair of feed rollers for feeding the associated web to the cutting device. The main characteristic of this device lies in the fact it includes a pulse generating unit for generating pulses having a phases related to the cutting device and a frequency which is a function of the cutting frequency of the cutting device, and drive means for the pair of rollers constituted by a stepping motor responsive to the pulse generating unit.

14 Claims, 5 Drawing Figures

FEEDING AND CUTTING DEVICE FOR A CONTINUOUS WEB

BACKGROUND OF THE INVENTION

The present invention relates to a device for feeding a continuous web and cutting it into pieces, having automatic reel change of the reels from which the web is unwound.

In known devices of the said type the web is unwound from a reel and supplied to periodic cutting means which operate in cycles corresponding to the production of a cut piece. Such feed means normally include a pair of rollers, the said unwinding rollers, which unwind the web from the reel and supply it to the cutting rollers. A device of this type can be used for unwinding and cutting a web from which the outer wrappings or labels of cigarette packets are formed.

In this case the webs have designs printed on them, which designs must be constantly centred, that is to say must be located in a predetermined fixed position on each piece (label) separated by the cutting means. For the purpose of obtaining a correct and constant centring of the printed device on each individual cut piece it is necessary to perform a detection operation and a registration operation before the cutting operation. For this purpose detection means, for example of optical type, detect any possible phase displacement of the designs printed on each section of the web intended to constitute an individual cut piece, with respect to the correct centred position.

A signal emitted by the said detection means constitutes the control for a registration device which includes means operable to correct the quantity of web unwound by the unwinding rollers for the purpose of nullifying any possible phase displacement. In the prior art the correction, for the purpose of re-centralising the printed design, can be effected by web transport means completely independent from the unwinding rollers or by means which control the unwinding rollers by adjusting their speed of rotation. Such registration devices, forming part of the feeding and cutting devices described, as well as being complex and often bulky, do not have a satisfactory precision and speed of response for use at the very high speeds of modern packaging machines.

A further disadvantage of such known feed and cutting devices becomes apparent whenever it is necessary to change from the production of pieces of a given longitudinal dimension to pieces having a different longitudinal dimension. This problem is resolved in the prior art by a manual operation requiring replacement of the unwinding rollers with unwinding rollers of a different diameter. Devices of the type in question are, moreover, provided with an automatic reel change device for the reels from which the web is unwound; that is to say as well as a first reel there is normally provided a second reel from which a second web can be unwound to replace the first, and there are provided means for detecting when the web in one of the reels is running out. When such detection means are activated the web being cut into pieces is exchanged. Such detection means generally include photodetecting devices or switches for detecting when the radius of the reel reduces down to a lower limit.

Normally the leading end of the replacement web is maintained stationary in a convenient position, and is then made to advance in dependence on a signal generated by such detection means. In particular, in the device described in British Pat. No. 1 215 047, the end of the replacement web is maintained close to the cutter blades, and the web feed rolls for such replacement web are activated when the end of the first web is detected, for example by means of a photocell. This automatic reel change device has several disadvantages, among which are the fact that the first piece of replacement web is slightly shorter than the predetermined length, and moreover, by being held waiting close to the cutting blades for the whole of the time that it takes for the other reel to be unwound, it can happen that very small scraps of web are cut off and, becoming electrostatically charged, are transported together with the cut pieces with disadvantages of various nature.

SUMMARY OF THE INVENTION

The object of the present invention is that of providing a device for feeding a continuous web and for cutting it into pieces, and automatically changing the reel from which the web is unwound, which overcomes all the above indicated disadvantages of the known devices, that is to say one which will allow the length of the pieces supplied to the cutter blades to be varied by any desired amount, both for the purpose of obtaining centralization of the devices printed on each individual cut piece and for the purpose of varying the basic or standard length of the cut pieces; a device which moreover allows automatic reel change of the reels from which the web is unwound to be obtained whilst maintaining the end of the replacement web spaced from the cutter blades, in which the length of the cut off pieces is always constant thereby avoiding the rejection of any cut pieces and without having to stop the device in any way.

Other objects and advantages obtained with the device of the present invention will become apparent from the following description.

According to the present invention a device for feeding a continuous web and cutting it into pieces, having automatic reel change of the reels from which the web is unwound, comprises a cyclic cutting device positioned at the confluence of two feed tracks for the two continuous webs unwound from corresponding reels, and detection means for producing a signal when an associated reel becomes empty; there being provided means for feeding the said webs from the said reels along each said track to the said cutting device, and the said feed means including, for each track, a pair of feed rollers for feeding the associated web to the said cutting device; the said device being characterised by the fact that it includes a pulse generating unit for generating pulses related to the phase of the said cutting device and having a frequency dependent on the cutting frequency of the said cutting device, and drive means for the said pair of rollers constituted by stepping motors controlled by the said pulse generating unit.

BRIEF DESCRIPTION OF THE DRAWINGS

For a better understanding of the present invention one embodiment is now described by way of non limitative example, with reference to the attached drawings, in which.

DETAILED DESCRIPTION OF THE INVENTION

Figure 1:
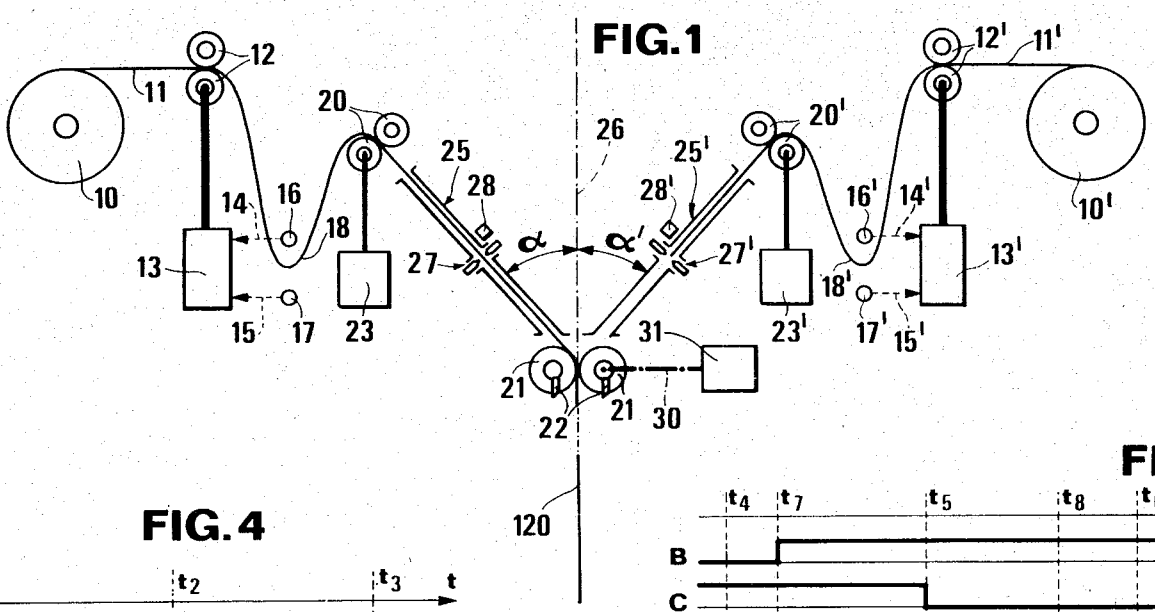
FIG. 1 is a schematic view of the device of the present invention.

With reference to FIG. 1, there is generally indicated a reel 10 from which a continuous web 11 is unwound; conveniently the web 11 is of more or less rigid paper on which, for example, a plurality of designs have been printed, which passes between a pair of cooperating rollers 12 for unwinding the web 11 from the reel 10. The rotation of the rollers 12 is detected and controlled by a motor block 13 to which are supplied signals, represented by the broken line arrows 14 and 15, from two associated photocell devices 16 and 17 which are disposed at different heights along the same vertical line. The web 11 in fact forms a loop 18 downstream of the rollers 12, which passes between the devices 16 and 17; it then rises to pass between a pair of cooperating web feed rollers 20 for feeding the web 11, and then, following a descending path, reaches a pair of cutter rollers 21 of known type, including, for example cooperating perimetral cutter blades 22. The rotation of the rollers 20 is detected and controlled by a stepping motor 23. In the section between the feed rollers 20 and the cutting rollers 21 the web 11 is guided by a channel 25 which is inclined at an angle $\alpha$ with respect to a vertical axis 26 passing through the cutting zone of the rollers 21. In an intermediate zone the channel 25 has an aperture formed therein and there are provided cutter blades 27 of known type, called shears, for being able to cut the web contained in the channel 25 at the predetermined zone. The distance of this zone from the cutting zone of the rollers 21 is fixed and is conveniently chosen in such a way that it is always less than the length of any cut-piece of any of the preselected lengths which it may be desired to cut.

At a distance from the cutting zone of the rollers 21 such as to be also less than the length of a cut piece there is provided a photocell device 28 which detects the passage of the web 11 within the channel 25, and in particular detects the passage of a reference mark on the web 11 which will be further described below. The cutting rollers 21 are driven by a mechanical shaft 30, in turn driven by a main motor 31 which can provide the movement for other devices of a machine to which the device of the present invention is fitted.

In the zone to the left of the axis 26 there is a configuration of elements symmetrical to that already described, and such elements are indicated with the same reference numeral with an added apostrophe. The said machine shaft 30 drives the various movable members of a machine, for example a cigarette packet wrapping machine. To this shaft 30 there is coupled a device 33 of known type which can provide a processing unit 34 with signals 35, the frequency and phase of which are tied to the speed and phase of rotation of the shaft 30.

In particular this device 33 can include toothed discs coupled to the shaft 30 and detector devices of the photoelectric or magnetic type etc. By such means the device 33 is able to detect the speed, phase and direction of rotation of the shaft 30. The processing block 34 has three outputs on which appear three signals 36, 37 and 38. The signal 36 is a logic pulse signal which is present at the commencement of each operating cycle corresponding to the production of one cut piece. The signal 37 is a logic pulse signal which periodically repeats at each operating cycle and is correlated, in a manner which will be further explained below, and with a fixed phase difference, to the cutting instant of the cutting rolls 21. The signal 38 is a pulse signal the frequency of which is dependent on the speed of rotation of the cutting rolls 21 and which serves as a control quantifying unit for the stepping motors 23 and 23', as well as for quantifying the cutting error and performing other fractions as will be explained below.

Such signal 38 therefore has a predetermined number of equally spaced pulses for each complete revolution of the cutting rollers 21; there may, for example, be 200 such pulses. The frequency of this signal 38 is therefore tied to the speed of rotation of the shaft 30 in the same way as the phases of the signals 36 and 37 are also tied to the phase of rotation of the shaft 30, which controls the rotation of the cutter rolls 21, and therefore are tied to the phase (angular position) of the cutter rollers 21 themselves. The signal 36 arrives at an input 40 of a circuit 41 for quantifying the error in centring of a printed design on each cut piece, and also arrives at zeroing inputs A of an algebraic summing block 42 and a counter 43. The signal 37 arrives at an input 44 of the circuit 41, and the signal 38 arrives at a counting input of the counter 43, at an input 46 of the circuit 41 and at one input of a three-input AND gate 47. The circuit 41 also has an input 50 which is connected to the outputs of two two-input AND gates 51 and 51' to which are fed, respectively, logic pulse signals 52 and 52' from the photocells 28 and 28', and a signal 53 (directly to the gate 51 and via an inverter 54 to the gate 51').

With reference to the circuit 41, the input 46 is connected to a counting input of a counter 55, which provides an output signal 56 to the algebraic summer 42. The input 40 is connected to the zeroing input of the counter 55 and to the zeroing inputs of two devices 58 and 58', of known type, which maintain at the output the logic level of the first edge of the input signal.

The input 44 is connected to the input of this device 58 and to an OR gate 60. The other input of the OR gate 60 and also the input of the device 58' are connected to the input 50 of the circuit 41. The outputs of such devices 58 and 58' are connected to the two inputs of a bistable multivibrator 61 on the output of which there is a signal 62 which is fed to the algebraic summer 42. The outputs of the devices 58 and 58' are each respectively connected to the output disabling input of the other of the devices 58, 58' respectively.

The output of the OR gate 60 is connected to the input of a bistable multivibrator 63 of the J-K type acting as a frequency divider, the output of which is fed to the count enabling input of the counter 55. The algebraic summer 42 also receives a signal 65 originating from a preselector block 66 including, for example, a plurality of microswitches operable by external digital selectors so as to arrange that the signal 65 is a representation of a binary coded number equal to a number of pulses for the stepping motor 23 and 23' such as to control the feeding of the web 11 or 11' for a theoretical length of one cut piece. The output of the algebraic summer 42 is passed to a first input of a comparator 67 to the other input of which is fed the output of the counter 43, and the output of which is fed to a second input of the gate 47. To a third input of the gate 47 there is fed a signal 69 emitted by a control device generally indicated as the block 70 this signal 69 controls the inhibition of the gate 47 in the case of holdups or breakages in the packaging machine detected by the device 70.

Figure 3:
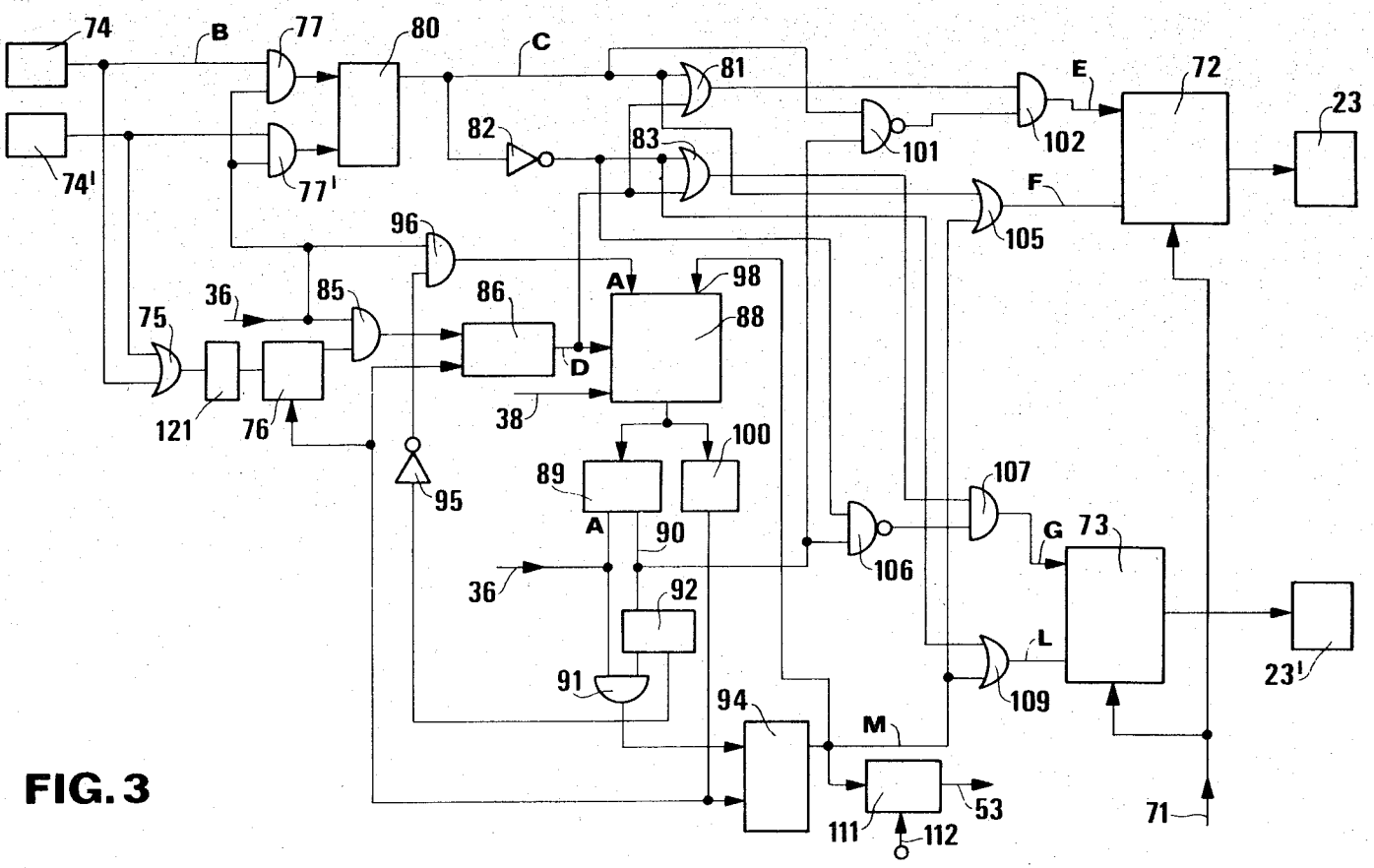

The output of the gate 47 provides a signal 71 which is fed respectively to a circuit 72 for controlling the stepping motor 23 and to a circuit 73 for controlling the stepping motor 23' (FIG. 3).

Still with reference to FIG. 3, two blocks of known type are indicated 74 and 74'; these are detectors for detecting when the respective reels 10 and 10' become empty; such detectors can, for example be provided with mechanical switches in contact with the reel, which switches are closed when the reel itself reaches a minimum thickness. The outputs of the detectors 74 and 74' are fed to two inputs of an OR gate 75 the output of which passes through a differentiator block 121 which gives a rectangular signal at its output corresponding to the rising or leading edge of the input signal; which is then fed to an input of bistable multivibrator 76. They are also fed to two inputs of two AND gates 77 and 77' respectively to the other inputs of which are fed the signal 36. The output of the gates 77 and 77' lead to the two inputs of a bistable multivibrator 80 the output of which is fed directly to an OR gate 81 and, via an inverter 82, to an OR gate 83. The output of the multivibrator 76 and the signal 36 are fed to the inputs of an AND gate 85 the output of which is fed to an input of a multivibrator 86 the output of which is connected to the other inputs of the OR gates 81 and 83 and also to an enabling input of a counter block 88 the counting input of which receives the signal 38. An output of the counter 88 leads to a block 89 which emits a signal 90 at its output when it reaches a predetermined number equal to the number of control pulses required by the motor 23 to advance the web 11 from the said intermediate zone of the channel 25 to the cutting region of the rollers 21 (the same is true for the corresponding elements indicated with an apostrophe).

The signal 90 is fed via a delay block 92 to one input of an AND gate 91 the other input of which also receives the signal 36. This signal 36 is moreover fed to a zeroing input A of the block 89. The output of the gate 91 is connected to the input of a bistable multivibrator 94. The signal 90 is also fed, via the delay block 92 and an inverter 95, to one input of an AND gate 96 which also receives the signal 36. The output of the gate 96 is connected to a zeroing input of the counter 88. The output of the multivibrator 94 is connected to an input 98 of the counter 88 selecting the counting direction; the output of this counter 88 is also connected to a block 100 which detects the ZERO count condition of the counter 88 itself.

The output of the block 100 is fed to the other input of the multivibrator 94, to the other input of the multivibrator 76, and to the other input of the multivibrator 86. The output of the multivibrator 80 and signal 90 are fed to the inputs of a NAND gate 101 the output of which is fed to the input of an AND gate 102 which also receives the output of the OR gate 81; the output of the gate 102 is connected to the enabling input of the circuit 72. The output of the multivibrator 80 is connected to one input of an OR gate 105 the other input of which receives the output of the multivibrator 94 and the output of which is connected to an input of the circuit 72 controlling the sense of rotation of the motor 23. The output of the inverter 82 is connected to one input of a NAND gate 106 the other input of which directly receives the signal 90 and the output of which is connected to one input of an AND gate 107 the other input of which receives the output of the OR gate 83. The output of the gate 107 is fed to the enabling input of the circuit 73. The output of the inverter 82 is fed to one input of an OR gate 109 the other input of which receives the output of the multivibrator 94 and the output of which is connected to the circuit 73 controlling the sense of rotation of the motor 23'.

Figure 2:
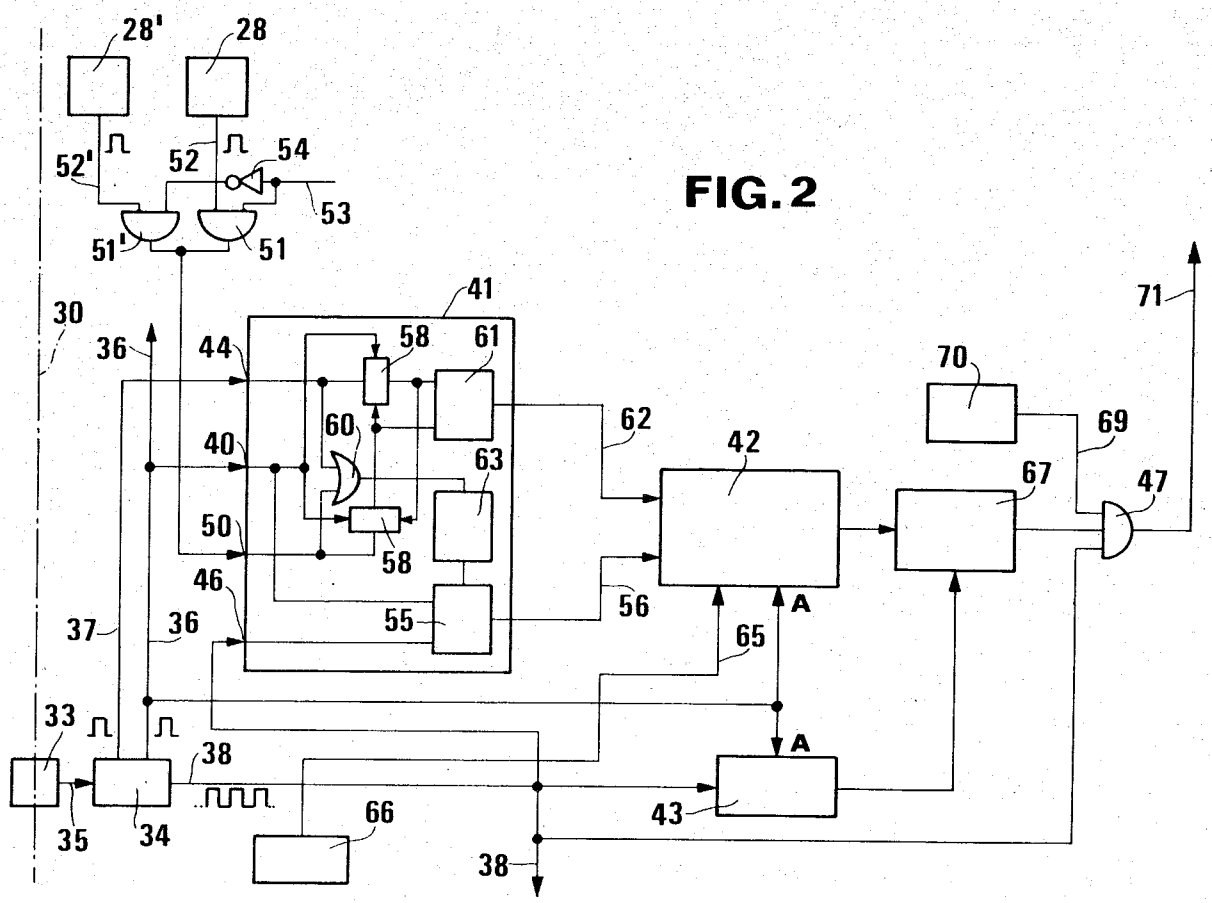
FIGS. 2 and 3 are block schematic diagrams of two detection and control circuits of the device of FIG. 1.

The output of the multivibrator 94 is moreover connected to the input of a bistable multivibrator 111 of the J-K type acting as a frequency divider the output of which generates a signal 53. This multivibrator 111 also receives a signal 112 to set the initial logic value of the signal 53. With reference to FIGS. 1, 2 and 3, the operation of the device of the present invention is as follows.

Only one of the webs 11 and 11' is unwound from the associated reel 10 or 10' except during the reel change phase, as will be described, during which only one of the webs 11 or 11' is supplied to the cutting rolls 21 which periodically, each 360° of rotation, cut a piece from it (a piece already cut is indicated in FIG. 1 with the reference numeral 120; this cut piece is moreover indicated spaced from the continuous web in that it is then advanced by the use of known devices).

The length of each cut piece is determined by the number of pulses sent in each cycle to the stepping motor 23 or 23' for controlling the corresponding arc of rotation of the feed rollers 20 or 20'. The control of the motors 23 or 23' will now first be described in more detail.

According to the device of the present invention the web 11 (11') is provided to the feed rollers 20 (20') with substantially zero tension in that the loop 18 (18') is always maintained between the photocells 16 and 17 (16' and 17') which control the unwinding rollers 12 (12') of the reel 10 (10') by means of a block 13 (13') so as to reduce the velocity thereof if this loop 18 (18') is below the photocell 17 (17') and to increase its velocity if the loop is above the photocell 16 (16'). During the normal operating phase only one of the webs 11, 11', as has been said, is fed to the cutting rollers 21, whilst the other remains with its end in the intermediate zone of the channel 25 or 25' respectively, and this precise arrangement is given by the cut effected by the shear blades 27 or 27'.

Supposing for example that the web being unwound is the web 11, at each cycle, after the signal 36 has zeroed the algebraic summer 42 and the counter 43, there is emitted by the summer 42 a signal corresponding to the number set by the preselector 66 and consequently corresponding to a predetermined length of cut piece.

When the comparator 67 detects equality between the signals emitted respectively by the summer 42 and the counter 43, or in other words at the instant in which the number of pulses 38 which have arrived via the gate 47 and the circuit 72, and control the motor 23, equals the number set on the block 66, comparator 67 closes the gate 47. Consequently the stepping motor 23 is no longer fed by the pulses 38 and stops, and the cutting rollers 21 effect a cut on the web 11, by now stationary, separating a cut piece of length corresponding to the number set on the block 66.

As already previously mentioned, the block 70 closes the gate 47 by means of the signal 69 and therefore controls the stepping motor 23 to stop in the case of holdups or breakages in the packaging machine. In the said operation condition of the stepping motor 23, the gate 102 (FIG. 3) in fact provides a comparison signal for the circuit 72 in that the output of the multivibrator 80 and therefore the output of the gate 81 being at the logic 1 level, the output of the NAND gate 101 is at the logic 1 level in that the signal 90 is absent, the output of the gate 102 itself is at the logic 1 level. Simultaneously the output of the gate 105 which controls the advancing rotation of the stepping motor 23 is at the logic 1 level. The control circuit 73 for the stepping motor 23' is, on the other hand, disabled, in that the output of the logic gate 83 is at the 0 and therefore the output of the AND gate 107 is at the zero level.

Supposing now that the web 11 which is cut has printed designs on it which must be perfectly centred for each piece which is cut from the length of the web. Conventionally, for such designs, there is also printed a reference mark which is detected by the photocell 28 so as to be able to quantify any possible difference with respect to the theoretical centred condition of the design on the cut piece in order to be able to vary the length of the cut piece itself in such a way as to maintain the design always centred.

Figure 4:
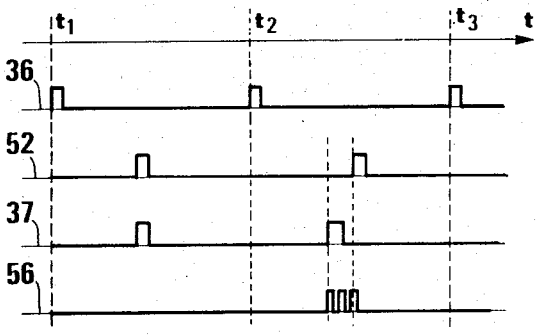

With reference to FIGS. 2 and 4 in which the cutting instants of the rollers 21 delimiting two operating cycles are indicated $t_1$, $t_2$ and $t_3$, and assuming that in the first cycle ($t_1$,$t_2$) the design is perfectly centred; therefore in that cycle, upon passage of the reference mark of the web in front of the photocell 28 a signal 52 is generated which through comparison with the signal 53 provided to the gate 51 arrives at the input 50 of the circuit 41 simultaneously with the signal 37 which arrives at the input 44 and which identifies, in a phase relationship, established by calibration, the cutting instant of the rollers 21 corresponding to a correct centralisation of the printed design. Since these signals arrive simultaneously at the inputs 44 and 50 the counter 55 is not activated so that it does not affect the algebraic summer 42 and therefore the number of impulses provided by the preselector block 66 does not vary.

Supposing, on the other hand, that in the period ($t_2$,$t_3$) the printed design is delayed with respect to the centring of the cut piece, the signal 37 will then arrive at the circuit 41 before the signal 52 so that the multivibrator 63 will control the counter 55 to operate in the interval between the arrival of the two pulses, the counter 55 therefore providing a signal 56 equal to a number of pulses 38 lying in the interval between the arrival of the said two pulses. Moreover the signal 37 will activate the multivibrator 61 which provides the signal 62 indicating the existance of a delay in the centring of the printed device. The next signal at the input 50 no longer has any influence on the multivibrator 61 since it can no longer arrive at this since the block 58 has disabled the output of the block 58'. The algebraic summer 42 therefore provides an output signal which adds the pulses of the signal 56 to the theoretical base number of pulses determined by the preselector block 66 with the correct sign provided by the signal 62, that is, in this case, a piece of greater length will be cut by the rollers 21 to allow centring of the printed design. In the device of the present invention the pulses which are counted by the counter 55 are the same as those counted by the counter 43 and which go to control the stepping motor 23, so that possible variations in the speed of rotation of the motor shaft 30, and therefore of the cutting rollers 21, do not introduce any errors in the length of the cut pieces. A variation in the length of the cut piece can be easily obtained by means of a change in the setting of the digital selectors of the block 66.

Figure 5:
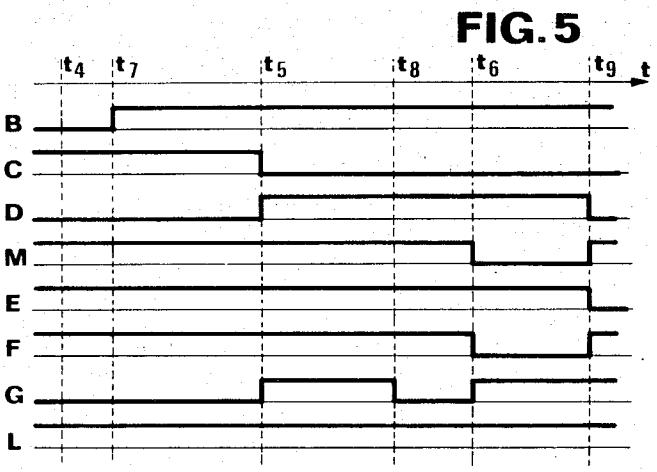
FIGS. 4 and 5 illustrate various signals occurring respectively in the diagrams of FIG. 2 and FIG. 3.

With reference to FIGS. 1, 3 and 5, it is now supposed that the web 11 has come to an end, detected at time $t_7$ by the detector device 74 which therefore provides a signal B at logic level 1. In this operating cycle ($t_4$, $t_5$) nothing happens until, at instant $t_5$, with the arrival of the signal 36 for initiation of the cycle, the gate 77 opens and this controls the multivibrator 80 the output signal C from which therefore goes from the logic 1 level to the zero level. Simultaneously the gate 85 opens to control the multivibrator 86 which assumes the logic level 1 (signal D) at its output. The output signal E from the gate 102 is therefore maintained at the level 1 to allow the operation of the stepping motor 23, and the signal F at the output of the gate 105 is also maintained at the logic level 1. The signal G at the output of the gate 107 is carried to the logic level 1 and the signal L at the output of the gate 109 is maintained at the logic level 1. Therefore in the operating cycle ($t_5$, $t_6$) both the motors 23 and 23' are enabled to operate in the sense of advancing movement, and being controlled by the same signal 71 which arrives at the control circuits 72 and 73, both the web 11 and the web 11' advance simultaneously. When the number of pulses 38 which drive the stepping motor 23', and which are also counted by the counter 88, indicate that the end of the web 11' has reached the cutting point of the cutting rollers 21, and such coincidence is detected by the block 89 which detects when the count in the counter 88 is equal to the value set as a function of this distance from the said intermediate zone of the channel 25' to the cutting zone of the rollers 21, the signal 90, at the instant $t_8$, blocks the gate 107 via the gate 106 so that the signal G enabling the circuit 73 is removed; therefore the stepping motor 23' stops so that the end of the web 11' stops in a position corresponding to the cutting zone of the rollers 21, whilst the motor 23 continues to advance so that the web 11 advances for a distance corresponding to the correct length of a cut piece. After the cut has been effected on the web 11 at the instant $t_6$, the signal 36 for a new operating cycle is generated, which enables the gate 91 which controls the multivibrator 94 so that a change in the logic state of the signal M occurs which controls a counting reversal of the counter 88. This counter 88 is in fact not zeroed immediately on the arrival of the signal 36 since the gate 96 is still open due to the presence of the signal 90 which is still present for a short period of time downstream of the delay circuit 92.

The signal M further causes a change in the level of the signal F at the output of the gate 105 to reverse the movement of the stepping motor 23; moreover, the zeroing of the signal 90 causes a change in the signal G to the logic level 1 to enable the control circuit 73. Therefore the rollers 20 are caused to run backwards so that the web 11 is drawn retracted or backwards into the channel 25, whilst the stepping motor 23' turns forwardly so that the feed rollers 20' feed the web 11' to the cutting rollers 21.

When the counter 88 arrives at zero, a blocking signal 100 is generated which changes the logic state of the signal at the output of the multivibrator 94 so that the stepping motor 23 is again set to run forwardly; moreover, the state of the signal D at the output of the multivibrator 86 changes so that (instant $t_9$) the signal E is zeroed and therefore the control to the motor 23 is stopped. The web 11 therefore remains stationary in the intermediate zone 27 and thus the reel 10 can be replaced with a new reel.

In the cycle which therefore starts at instant $t_6$, and in subsequent cycles, only the stepping motor 23' is controlled to unwind the web 11' until the reel 10' is empty, which is detected by the detector block 74' following which the complementary operations from those already described take place.

In changing the logic state of the signal M a division of frequency is effected by the multivibrator 111 so that the signal 53, initially set, for example with manual selectors, in a correct manner via the signal 112 at the instant $t_6$ causes a change between the gates 51 and 51' so that the signal 52' can pass to the input 50 of the circuit 41.

From what has been described the advantages of the device according to the present invention will become clearly evident.

In particular the characteristic of always maintaining the tension on the web which is supplied to the feed rollers substantially zero during the whole of the unwinding of the web from the reel is rather advantageous because such feed rollers 20 can be controlled by stepping motors which therefore allow a very precise positioning and a very precise determination of the length of the piece which must be cut. It is therefore very simple to vary the standard length of each piece by correcting possible defects in the centering of designs printed on the pieces, to effect the automatic change of the unwound reel without any interruption in the operation of the device, without any reject workpieces, and without any errors in the length of the cut pieces. Finally, it is clear that the embodiment described and illustrated can be modified and varied without departing from the scope of the invention itself. For example, as already indicated, the part relating to the correction of the centering of the printed designs can be omitted when such designs are not used, for example in the case of cutting webs of foil or transparent material etc. Moreover, the photocell devices 28,28' can be positioned the length of a certain number of cut pieces in advance of that which is being cut in a given cycle, suitable displacement adjustments being effected to delay the corresponding cycles, disposed for example between the algebraic summer 42 and the comparator 67.

I claim:

1. A device for feeding and cutting a continuous web (11, 11') into cut pieces (120), having automatic reel change for a reel from which the web is unwound, including a cyclic cutting device (21) located at the confluence of two tracks (25) along which two continuous webs (11, 11') unwound from corresponding reels (10, 10') are fed, and control means (74, 74') generating a signal when an associated reel becomes empty; there being provided feed means (12, 20) for feeding said webs from the said reels (10) along each of the said tracks to the said cutting device (21), and the said feed means including, for each track, a pair of feed rollers (20) for feeding the associated web (11) to the said cutting device (21); the said device including a pulse generating unit (33, 34) for generating pulses which are phase related to the said cutting device (21) and a frequency of which is a function of a cutting frequency of the said device (21), and means (23) constituted by stepping motors controlled by the said pulse generating unit (33) for directly driving the said pair of rollers (20) in one direction for feeding said web and in a reverse direction for retracting said web; the said feed means (12, 20) comprising as well as the said pair of feed rollers (20) actuated by a first control circuit (23, 72), at least one pair of unwinding rollers (12) actuated by a second control circuit (13) to unwind the said web from a reel (10) towards the said feed rollers (20), the said second control circuit including means (16, 17) operable to maintain a substantially zero tension on the said web (11) at the said feed rollers (20) during the whole of the unwinding of the reel (10), the said stepping motor (23) being fed at each operating cycle by means of a control circuit (67, 47, 72) with a number of pulses (38) determining the passage of a cut piece of predetermined length between the said feed rollers (20), and including means (66) for selectively changing the predetermined length of the said cut piece, the said means varying the number of pulses (38) sent to the said stepping motor (23), the device further including reel change means (80, 88, 94, 86) actuated by the said means (74, 74') for detecting when a first web has been used up and, in a first operating cycle, simultaneously with the production of a piece cut from the said first web (11), controlling the arrival and stopping of the end of a second, replacement web (11') at the said cyclic cutting means (21), and in following operating cycles controlling the supply of only the said replacement web (11') to the said cyclic cutting means (21) to obtain pieces cut only from the said second web (11'), and including means (27, 27') for positioning the end of the said replacement web (11') at a predetermined distance from the said cyclic cutting means (21) during the unwinding of the first web (11), the said reel change means controlling the advancing movement of the said replacement web (11') in the operating cycle following that in which the said means (74) for detecting the end of the web being unwound are activated, and controlling a retraction of the end of the web (11) which is running out from the said cutting means (21) during the first operating cycle producing a piece (120) cut from the said second replacement web (11').

2. A device according to claim 1, characterised by the fact that the said means of the said second control circuit include a pair (16,17) of photo-electric detector elements operable to maintain a loop (18) of the said web (11) between the said unwinding rollers (12) and the said feed rollers (20) between predetermined limit values.

3. A device according to claim 1, characterised by the fact that it includes correction means (28,41,42) for cutting the said web (11) at predetermined regions of the web itself, the said correction means including means (28) for detecting at least one reference mark for each said region on the said web, means (41) for controlling the position of each said predetermined cutting region with respect to a cutting region determined by actuation of the said cyclic cutting means and for quantifying any possible difference existing between the said two regions, and comparison means (42) for comparing the said possible difference with a predetermined length of the said cut piece to obtain a correct length value, the said correct value being used, via a control circuit (67,47, 72) to control the said stepping motor (23) in the associated operating cycle for a number of pulses (38) determining the passage of a piece of web of correct length between the said feed rollers (20).

4. A device according to claim 3, characterised by the fact that the said control and quantifying means (41) include logic circuits and a first counter (55) operable to provide signals (62,56) representing the said possible difference existing between the said two regions, both as to sign with respect to the said predetermined region and as to absolute value with respect to a predetermined quantifying unit determined as a function of a pulse signal (38) which arrives at the said first counter and the frequency of which is a function of the speed of the said cyclic cutting means (21).

5. A device according to claim 4, characterised by the fact that the said comparison means (42) include an algebraic summing circuit for summing the said predetermined length of the said cut piece and the said possible difference.

6. A device according to claim 5, characterised by the fact that the said control circuit includes a comparator circuit (67) receiving the said correct length value from the said comparison means (42) and an output value from a second counter (43) receiving the said pulse signal (38), the output of the said comparator controlling the transfer of the said pulse signal (38) to the said stepping motor (23) until the said number of pulses determining the said correct length value have been generated.

7. A device according to claim 1, characterised by the fact that the said positioning means include shear blades (27, 27') for cutting the said web at a region predetermined by the position of the said blades.

8. A device according to claim 7, characterised by the fact that the said blades (27,27') are positioned at a distance from the said cutting means (21) less than the length of a cut piece (120).

9. A device according to claim 1, characterised by the fact that the said retraction of the said end of the said first web (11) which is running out is effected for a distance equal to the distance from the end of the said second, replacement web (11') from the said cyclic cutting means (21) during the unwinding of the first web (11).

10. A device according to claim 9, characterised by the fact that the said reel change means include a counter (88) for counting the distance according to a predetermined quantifying unit which is a function of a pulse signal (38) from the said unit (33,34).

11. A device according to claim 1, characterised by the fact that the said reel change means include logic circuits.

12. A device according to claim 1, characterised by the fact that the said web (11,11') has printed designs thereon which are to be centered in each cut piece.

13. A device according to claim 1, characterised by the fact that the said web (11,11') is a metal foil.

14. A device according to claim 1, characterised by the fact that the said web (11,11') is of a type usable for wrapping cigarette packets.

* * * * *